US010928061B2

(12) United States Patent
Rasi et al.

(10) Patent No.: US 10,928,061 B2
(45) Date of Patent: Feb. 23, 2021

(54) GAS BURNER AND HOB COMPRISING A GAS BURNER

(71) Applicant: ELECTROLUX APPLIANCES AKTIEBOLAG, Stockholm (SE)

(72) Inventors: Fabio Rasi, Forli (IT); Maurizio Beghi, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 360 days.

(21) Appl. No.: 15/774,296

(22) PCT Filed: Nov. 4, 2016

(86) PCT No.: PCT/EP2016/076629
§ 371 (c)(1),
(2) Date: May 8, 2018

(87) PCT Pub. No.: WO2017/089092
PCT Pub. Date: Jun. 1, 2017

(65) Prior Publication Data

US 2020/0256557 A1 Aug. 13, 2020

(30) Foreign Application Priority Data

Nov. 26, 2015 (EP) ..... 15196534

(51) Int. Cl.
*F23D 14/06* (2006.01)
*F23L 1/00* (2006.01)

(52) U.S. Cl.
CPC ..... *F23D 14/06* (2013.01); *F23L 1/00* (2013.01); *F23D 2203/1026* (2013.01); *F23D 2212/20* (2013.01)

(58) Field of Classification Search
CPC ..... F23D 14/06; F23D 2203/1026; F23D 2212/20; F23L 1/00
See application file for complete search history.

(56) References Cited

U.S. PATENT DOCUMENTS 1,839,366 A * 1/1932 Alig ..... F23D 14/06 239/559
3,589,620 A * 6/1971 Davis ..... F23D 14/06 239/434

(Continued)

FOREIGN PATENT DOCUMENTS

CN 104696962 A 6/2015
CN 104930516 A 9/2015

(Continued)

OTHER PUBLICATIONS

Cinimo, S.; Russo, G. "Radiant Catalytic Cooktop Burner." p. 1, Section 2 "Description of the catalytic burner." Processes and Technologies for a Sustainable Energy. Ischia, Jun. 27-30, 2010.

(Continued)

*Primary Examiner* — Alfred Basichas
(74) *Attorney, Agent, or Firm* — Pearne & Gordon LLP

(57) ABSTRACT

The invention relates to a gas burner comprising: —an injection holder (2) with a gas injector (2.1); —a burner body (3) adapted to be arranged at the injection holder (2), the burner body (3) comprising an opening (3.1) for enabling a gas flow from said gas injector (2.1) and a primary air flow in an area above said burner body (3); —a burner cap (4) adapted to be arranged at the top side of the burner body (3), the burner cap (4) comprising a bottom portion (4.1) and a circumferential surface portion (4.2) protruding downwardly from said bottom portion (4.1), wherein the circumferential surface portion (4.2) comprises a plurality of flame ports (4.3) and said burner body (3) and said burner cap (4) confine a chamber (5) for providing a combustion mixture of gas and primary air; wherein the burner body (3) comprises a bulge-shaped protrusion (3.5) forming a continuous ridge below the burner cap (4) at least in the area in which the flame ports (4.3) are provided, said bulge-shaped protrusion (Continued)

(3.5) reducing the distance between the burner cap (4) and the burner body (3) in the area of the flame ports (4.3).

19 Claims, 3 Drawing Sheets

(56) References Cited

U.S. PATENT DOCUMENTS

| | | | | |
|---|---|---|---|---|
| 3,921,913 | A * | 11/1975 | Capy | F23D 14/46 239/553 |
| 5,464,004 | A | 11/1995 | Maughan | |
| 5,800,159 | A | 9/1998 | Maughan et al. | |
| 5,865,615 | A | 2/1999 | Simpson et al. | |
| 5,899,681 | A | 5/1999 | Maughan | |
| 6,146,132 | A | 11/2000 | Harneit | |
| 6,209,534 | B1 | 4/2001 | Taplan | |
| 6,322,354 | B1 | 11/2001 | Carbone et al. | |
| 6,325,619 | B2 | 12/2001 | Dane | |
| 6,589,046 | B2 | 7/2003 | Harneit | |
| 6,817,355 | B1 | 11/2004 | Hawkins et al. | |
| 7,802,567 | B2 | 9/2010 | Cadima et al. | |
| 7,841,332 | B2 | 11/2010 | Pottenger et al. | |
| 7,871,264 | B2 | 1/2011 | Pryor et al. | |
| 8,171,927 | B2 | 5/2012 | Pryor et al. | |
| 8,596,259 | B2 | 12/2013 | Padgett et al. | |
| 8,683,991 | B2 | 4/2014 | Gasparini | |
| 8,746,229 | B2 | 6/2014 | Lacche | |
| 8,747,108 | B2 | 6/2014 | Lona Santoyo et al. | |
| 8,863,735 | B2 | 10/2014 | Cadima | |
| 9,285,115 | B2 | 3/2016 | Gasparini | |
| 9,453,641 | B2 | 9/2016 | Cadima | |
| 9,513,012 | B2 | 12/2016 | Gen et al. | |
| 9,593,854 | B2 | 3/2017 | Rasi et al. | |
| 9,909,762 | B2 | 3/2018 | Emiliani | |
| 2001/0010897 | A1 | 8/2001 | Dane | |
| 2007/0059654 | A1 | 3/2007 | Armanni | |
| 2011/0129783 | A1 | 6/2011 | Harneit | |
| 2013/0174837 | A1 | 7/2013 | Cadima | |
| 2014/0116416 | A1 * | 5/2014 | Saubert | F24C 15/005 126/39 E |
| 2014/0318527 | A1 * | 10/2014 | Silva | F24C 3/08 126/39 E |
| 2015/0345799 | A1 | 12/2015 | Cadima et al. | |
| 2016/0327277 | A1 | 11/2016 | Emiliani | |
| 2016/0341430 | A1 | 11/2016 | Emiliani | |
| 2017/0038061 | A1 | 2/2017 | Geng et al. | |

FOREIGN PATENT DOCUMENTS

| | | | |
|---|---|---|---|
| EP | 0945681 | B1 | 10/2003 |
| EP | 2487413 | A1 | 8/2012 |
| EP | 3173697 | A1 | 5/2017 |
| GB | 2100411 | A | 12/1982 |
| GB | 2272283 | A | 5/1994 |
| JP | 2008202866 | A | 9/2008 |
| WO | 2015107446 | A1 | 7/2015 |
| WO | 2015107448 | A1 | 7/2015 |

OTHER PUBLICATIONS

International Search Report & Written Opinion issued in corresponding application No. PCT/EP2016/076629 dated Jan. 30, 2017, 8 pgages.

* cited by examiner

GAS BURNER AND HOB COMPRISING A GAS BURNER

Generally, the present invention relates to the field of gas burners. More specifically, the present invention relates to a gas burner with a burner body and a burner cap comprising flame ports, the burner body and the burner cap confining a distribution chamber for providing a combustion mixture of gas and primary air.

BACKGROUND OF THE INVENTION

Gas burners are well-known in prior art. Specifically, cooking hob gas burners are known which comprise an injection holder for coupling the gas burner with the cooking hob, a burner body and a burner cap. Said burner body and burner cap form a combustion gas chamber providing a mixture of gas and primary air to a plurality of flame ports.

Disadvantageously, the apertures forming the flame ports are quite small and therefore are difficult to clean. In addition, said gas burners show a limited capability of managing the speed of gas-primary air mixture which limits the efficiency of the gas burner.

SUMMARY OF THE INVENTION

It is an objective of the embodiments of the present invention to provide a gas burner with improved gas-primary air mixture capabilities and improved burner efficiency. If not explicitly indicated otherwise, embodiments of the invention can be freely combined with each other.

According to an aspect, the invention relates to a gas burner comprising:

an injection holder with a gas injector;

a burner body adapted to be arranged at the injection holder, the burner body comprising an opening for enabling a gas flow from said gas injector and a primary air flow into an area above said burner body;

a burner cap adapted to be arranged at the top side of the burner body, the burner cap comprising a top portion and a circumferential surface portion protruding downwardly from said top portion, wherein the circumferential surface portion comprises a plurality of flame ports and said burner body and said burner cap confine a chamber for providing a combustion mixture of gas and primary air;

wherein the burner body comprises a bulge-shaped protrusion forming a continuous ridge below the burner cap at least in the area in which the flame ports are provided, said bulge-shaped protrusion reducing the distance between the burner cap and the burner body in the area of the flame ports.

Said gas burner is advantageous because by providing said protrusion close to the flame ports the speed of the gas/primary air mixture is lowered which leads to an improved burner efficiency and enhanced flame stability.

According to embodiments, the bulge-shaped protrusion comprises a first ring-shaped protrusion portion, said first ring-shaped protrusion portion being arranged concentric and at a certain distance to the circumferential surface portion of the burner cap. So, in other words, in close distance to the circumferential surface portion the first ring-shaped protrusion portion is arranged in order to narrow the combustion gas chamber in the area of the flame ports. Thereby, a better managing of gas-primary air mixture speed is possible.

According to embodiments, the distance between the first ring-shaped protrusion portion and the circumferential surface portion of the burner cap is in the range between 1.5 mm and 6 mm. Said range is advantageous for achieving a suitable gas-primary air mixture speed.

According to embodiments, the bulge-shaped protrusion comprises a second ring-shaped protrusion portion, said second ring-shaped protrusion portion being arranged parallel or essentially parallel and at a certain distance to the lower portion of the burner cap. Thereby, also in the area of a lower portion of the burner cap the combustion gas chamber is narrowed thereby further reducing the gas-primary air mixture speed.

According to embodiments, the distance between the second ring-shaped protrusion portion and the lower portion of the burner cap is in the range between 1.2 mm and 1.8 mm. Said range is advantageous for achieving a suitable gas-primary air mixture speed.

According to embodiments, the burner body is formed by aluminium and said bulge-shaped protrusion is integrally formed at said burner body. For example, said bulge-shaped protrusion may be formed by deep drawing. However, also other processes for manufacturing the burner body are possible.

According to embodiments, the burner cap is formed by a sheet metal, specifically by a drawn or deep drawn sheet metal.

According to embodiments, the flame ports are constituted by elongated apertures. Thereby, the cleaning capability of the gas burner is further improved.

According to embodiments, the circumferential surface portion of the burner cap is inclined with respect to a vertical axis. Thereby, a circumferential flame exit is achieved.

According to embodiments, the elongated apertures forming the flame ports are diagonally arranged at the circumferential surface portion. Specifically, the elongated apertures are diagonally arranged such that the longitudinal axes of the apertures and a vertical axis confine an angle greater than 20°, specifically greater than 25°. Thereby, the efficiency of the gas burner is further improved.

According to embodiments, a passage for primary air is provided at the lower side of the burner body. Specifically, the passage for primary air is provided between the lower side of the burner body and a hob portion into the injection holder such that the primary air and the gas is flowing through an opening provided in the burner body into the combustion gas chamber.

According to embodiments, the distance between the second protrusion portion and the lower portion of the burner cap is chosen such that the ratio of the annular circumferential flow area between the second protrusion portion and the lower portion and the exit surface of the combustion gas at the flame ports is between 0.8 and 1.2, preferably equal. In other words, due to the bulge-shaped protrusion the radial flow cross section of the combustion gas chamber is reduced such that the flow cross section between the burner cap and the burner body is equal, essentially equal (or within upper-mentioned range) to the flow cross section created by all flame ports of the burner cap. Thus, the gas flow cross section is not (only) limited by the flame ports but the bulge-shaped protrusion acts as a flow cross section limiter.

According to a further aspect, the invention refers to a gas burner configured according to anyone of the preceding embodiments.

The terms "essentially", "substantially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
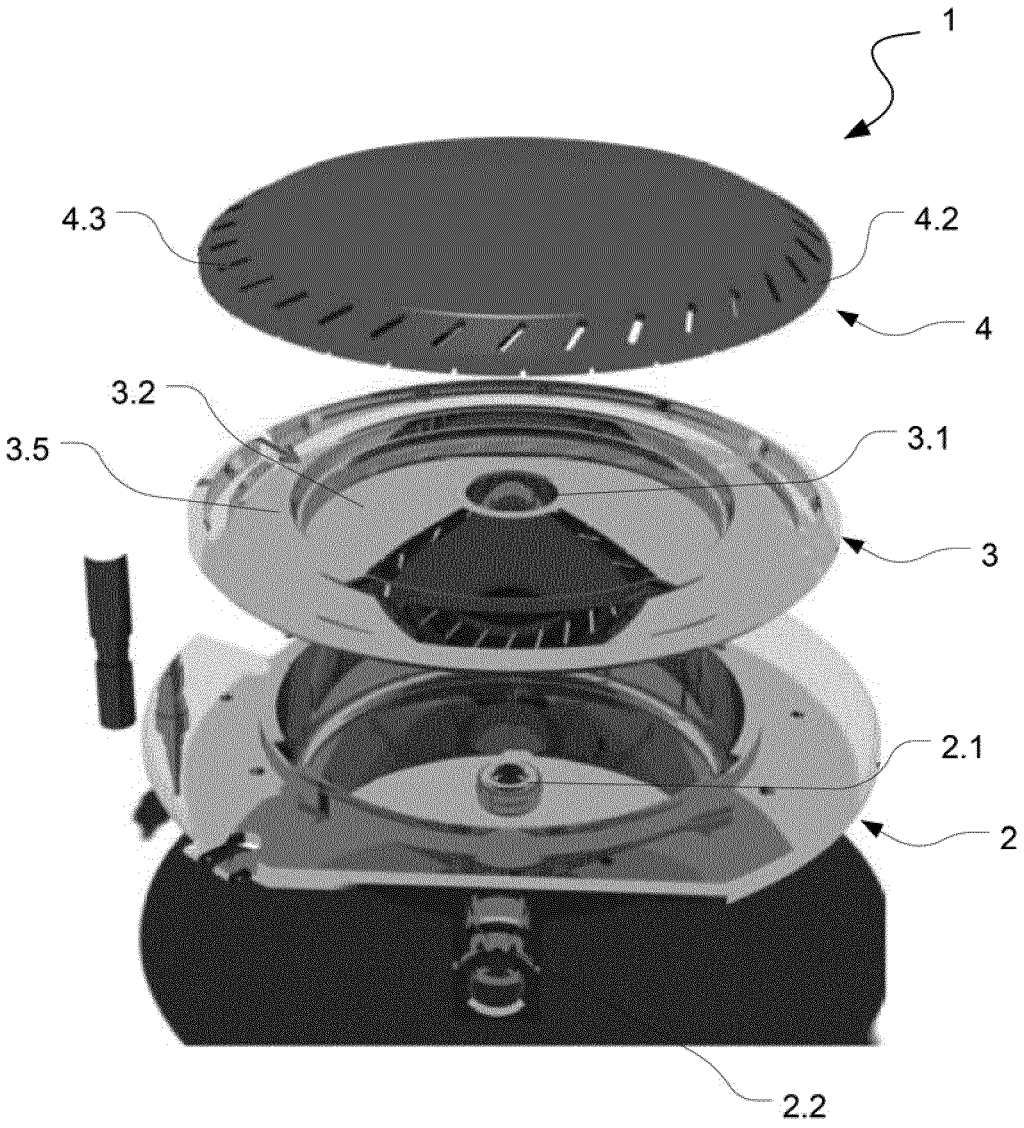
FIG. 1 shows an example exploded perspective view of a gas burner.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

Figure 2:
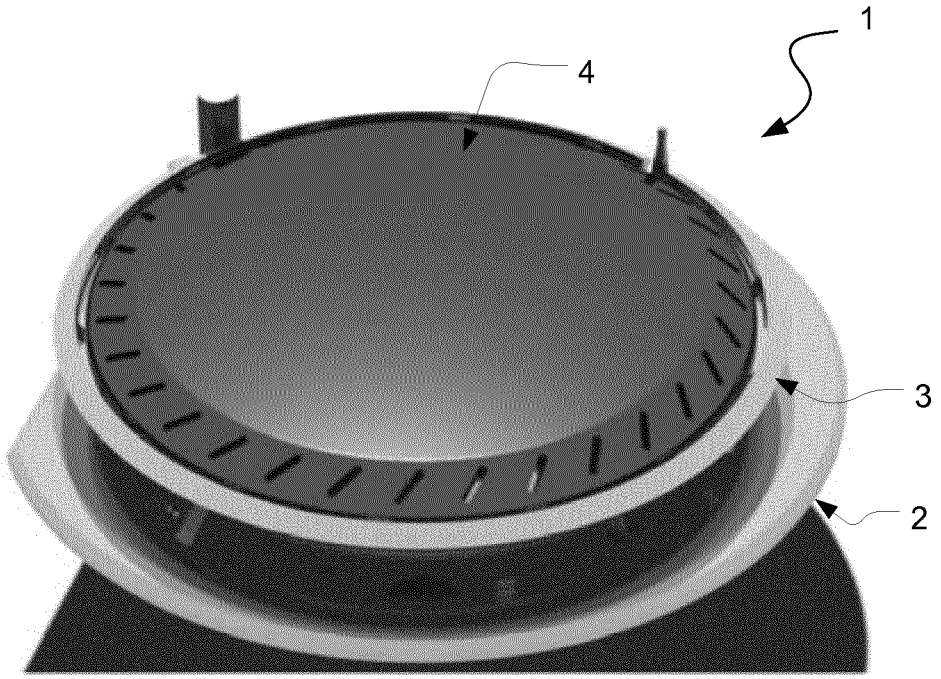
FIG. 2 shows an example perspective view of the gas burner according to FIG. 1 after assembling.

FIG. 1 illustrates an embodiment of a gas burner 1 in an exploded view and FIG. 2 illustrates said gas burner 1 after assembling. The gas burner 1 comprises an injector holder 2. Said injector holder 2 may comprise a cup-like or essentially cup-like shape. More in detail, the injector holder 2 may comprise a circumferential flange by which the injector holder 2 can be fixed in traditional manner to a cooking hob.

The injector holder 2 may comprise a base portion at which a seat for a gas injector 2.1 is provided. The gas injector may be arranged such that gas is ejected in a vertical or essentially vertical direction. The gas injector 2.1 is coupled with a gas conduit 2.2 provided at the injector holder 2 in order to provide gas to the gas injector 2.1.

Figure 3:
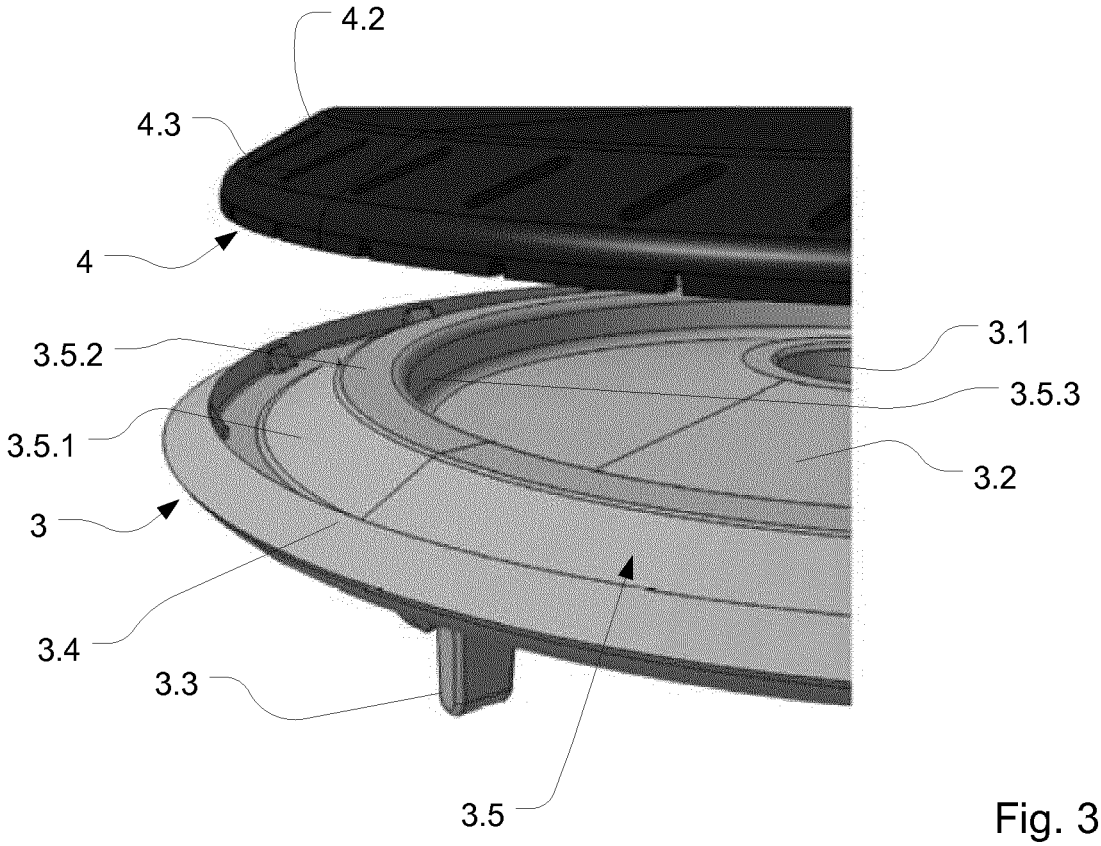
FIG. 3 shows the burner body and the burner cap in an exploded perspective view.
Figure 5:
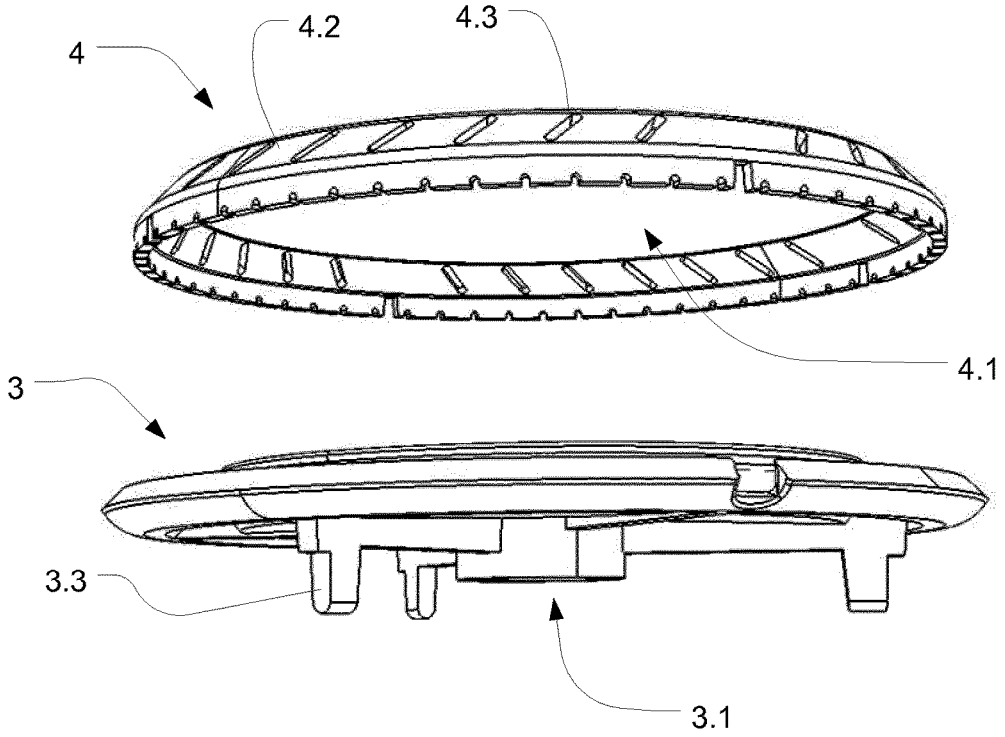
FIG. 5 shows the burner body and the burner cap in a further exploded perspective view.

In addition, the gas burner 1 comprises a burner body 3. Said burner body 3 is adapted to be positioned on the upper side of the injector holder 2. As shown in FIGS. 3 and 5, the burner body 3 comprises an opening 3.1 which is preferably arranged in the center of the burner body 3. For example, said opening 3.1 may be constituted by a cylindrical or substantially cylindrical tubular portion. The opening 3.1 may be arranged coaxial with the gas injector 2.1.

Surrounding the opening 3.1, the burner body 3 comprises a circular bottom wall portion 3.2 in order to confine a combustion gas chamber 5 at a bottom side. Said combustion gas chamber 5 may be a radial Venturi effect chamber. Said bottom wall portion 3.2 may comprise a convex shape (referring to a top view).

At the lower surface of the burner body 3, protrusions 3.3 are arranged for supporting the burner body 3 at the injector holder 2. Said protrusions 3.3 provide a gap between the injector holder 2 and the burner body 3 through which primary air is able to enter the interior of the injector holder 2.

The gas burner 1 further comprises a burner cap 4 adapted to be arranged on the burner body 3. More specifically, the burner cap 4 may be removably resting on said burner body 3. The burner cap 4 comprises a lower portion 4.1 which may be arranged in a horizontal or essentially horizontal plane. In an alternative embodiment, the lower portion 4.1 may have a convex shape (referring to a top view).

In addition, the burner cap 4 comprises a circumferential surface portion 4.2 which is bent downwards. In other words, the circumferential surface portion 4.2 is inclined downwardly with respect to the lower portion 4.1.

At said circumferential surface portion 4.2, a plurality of flame ports 4.3 are arranged. Said flame ports may be circumferentially distributed over the circumferential surface portion 4.2. The flame ports 4.3 may be constituted by elongated apertures through which a combustion mixture of primary air and gas passes through in order to generate a ring of flames. Said elongated apertures may be diagonally arranged (i.e. from top left to bottom right or vice versa). For example, the elongated apertures may be inclined by an angle more than 20°, specifically, more than 25°, e.g. in the range between 30° and 45°. The elongated apertures forming the flame ports 4.3 may have a height of 3.0 mm and 7.0 mm and a width between 1.0 mm and 1.7 mm.

The burner body 3 comprises an annular rim 3.4 protruding upwardly which confines an area for receiving the burner cap 4. The outer edge of the circumferential surface portion 4.2 may interact with said annular rim 3.4 of the burner body 3 in order to provide a lateral fixation of the of the burner cap 4 at the burner body 3. The burner cap 4 comprises a radial extension less than the radial extension of the annular rim 3.4 of the burner body 4.

Figure 4:
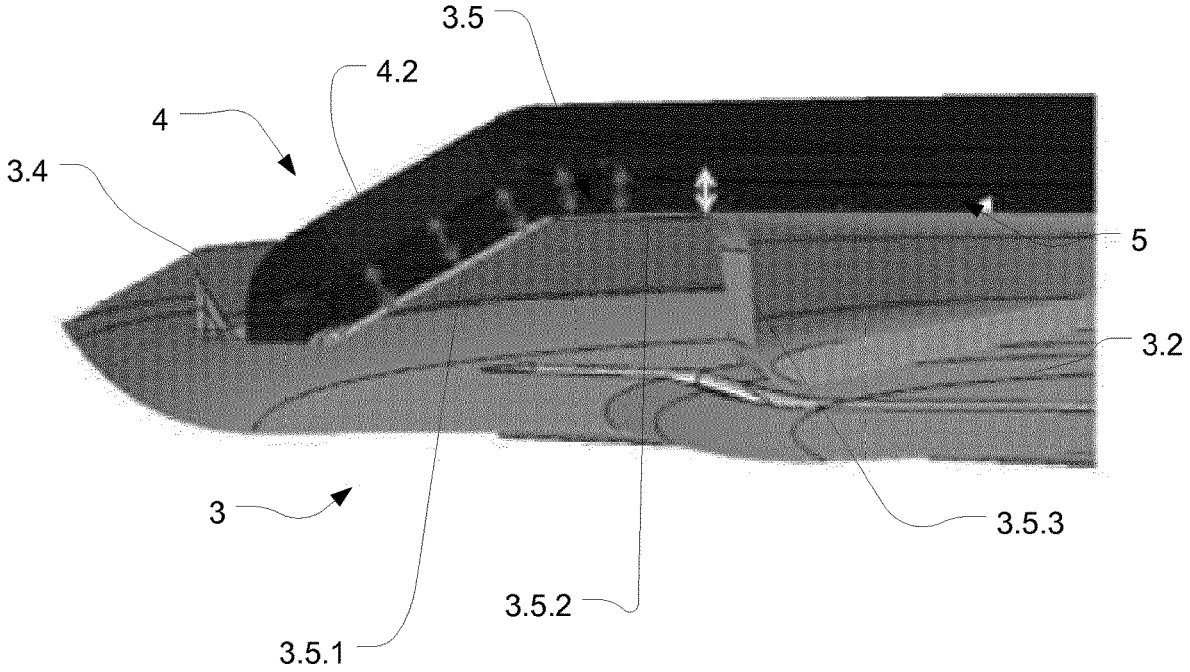
FIG. 4 shows an example lateral sectional view of the burner body and the burner cap assembled at the burner body.

In order to improve the managing of gas/primary air mixture speed, the burner body 3 comprises a bulge-shaped protrusion 3.5 (FIGS. 3 and 4). Said protrusion 3.5 forms a continuous ridge or dam below the burner cap 4, i.e. the protrusion 3.5 may comprise a ring-like shape. Said protrusion 3.5 is adapted to the shape of the burner cap 4 such that the distance between the burner body 3 and the burner cap 4 is significantly reduced in the area of the flame ports 4.3.

The protrusion 3.5 may comprise a first protrusion portion 3.5.1 which corresponds with respect to its shape and its inclination to the circumferential surface portion 4.2 of the burner cap 4. In addition, the protrusion 3.5 may also comprise a second protrusion portion 3.5.2 which corresponds with respect to its alignment and its inclination to a border section of the lower portion 4.1. More in detail, the first protrusion portion 3.5.1 is arranged in close proximity to the circumferential surface portion 4.2 in which the flame ports 4.3 are provided. There may be only a gap between said first protrusion portion 3.5.1 and the circumferential surface portion 4.2 in order to enable the gas/primary air mixture to reach the flame ports 4.3. The distance between the first protrusion portion 3.5.1 and the circumferential surface portion 4.2 may be in the range between 1.5 mm to 6 mm. The gap between the second protrusion portion 3.5.2 and the border section of the bottom portion 4.1 may be in the range between 1.2 mm to 1.8 mm, specifically 1.3 mm, 1.4 mm, 1.5 mm, 1.6 mm or 1.7 mm.

The third protrusion portion 3.5.3 which faces the opening 3.1 of the burner body (i.e. which is located opposite to the first protrusion portion 3.5.1) and connects the second protrusion portion 3.5.2 with the upper wall portion 3.2 may protrude vertically or essentially vertically from said bottom wall portion 3.2. Thus, the protrusion 3.5 may form a dam-like barrier for the combustion mixture and said combustion mixture is forced to overcome said obstacle in order to reach the flame ports 4.3. In other words, the combustion gas chamber is reduced in the area of the flame ports 4.3 by means of said dam-like, ring-shaped protrusion. Thereby the gas-primary air mixture is improved which permits to reduce and better manage the gas-primary air mixture speed.

In addition, the radial flow cross section area provided between the lower portion 4.1 of the cap 4 and the protrusion 3.5 through which the combustion gas has to flow may be chosen such that said ratio between said radial flow cross section area and the total exit area provided by the flame ports 4.3 is in the range between 0.8 and 1.2, specifically is 1.0 or essentially 1.0. In other words, the distance between the lower portion 4.1 and the protrusion 3.5 is chosen according to the total flow cross section provided by the flame ports 4.3. Thereby, an improved control of the gas/primary air mixture speed is possible.

The burner cap 4 may be a single piece element made of drawn sheet metal, e.g. of steel, aluminum, brass, stainless steel, sintered steel or other suitable metal alloys. The burner body 3 may be preferably made of aluminum.

It should be noted that the description and drawings merely illustrate the principles of the proposed gas burner. Those skilled in the art will be able to implement various arrangements that, although not explicitly described or shown herein, embody the principles of the invention.

LIST OF REFERENCE NUMERALS

1 gas burner
2 injection holder
2.1 gas injector
2.2 gas conduit
3 burner body
3.1 opening
3.2 bottom wall portion
3.3 protrusion
3.4 annular rim
3.5 protrusion
3.5.1 first protrusion portion
3.5.2 second protrusion portion
3.5.3 third protrusion portion
4 burner cap
4.1 lower portion
4.2 circumferential surface portion
4.3 flame port
5 combustion gas chamber

The invention claimed is:

1. A gas burner comprising:

an injection holder with a gas injector;

a burner body adapted to be arranged at the injection holder, the burner body comprising an opening for enabling a gas flow from said gas injector and a primary air flow in an area above said burner body; and a burner cap adapted to be arranged at a top side of the burner body, the burner cap comprising a bottom portion and a circumferential surface portion protruding downwardly from said bottom portion, wherein the circumferential surface portion comprises a plurality of flame ports and said burner body and said burner cap confine a chamber for providing a combustion mixture of gas and primary air, wherein the burner body comprises a bulge-shaped protrusion forming a continuous ridge below the burner cap at least in an area in which the flame ports are provided, said bulge-shaped protrusion reducing a distance between the burner cap and the burner body in the area of the flame ports, wherein the bulge-shaped protrusion comprises a first ring-shaped protrusion portion being essentially parallel to said circumferential surface portion of the burner cap.

2. The gas burner according to claim 1, wherein said first ring-shaped protrusion portion is arranged concentric and at a certain distance to the circumferential surface portion of the burner cap.

3. The gas burner according to claim 2, wherein the distance between the first ring-shaped protrusion portion and the circumferential surface portion of the burner cap is in the range between 1.5 mm to 6 mm.

4. The gas burner according to claim 1, wherein the bulge-shaped protrusion comprises a second ring-shaped protrusion portion, said second ring-shaped protrusion portion is arranged essentially parallel and at a certain distance to the bottom portion of the burner cap.

5. The gas burner according to claim 4, wherein the distance between the second ring-shaped protrusion portion and the bottom portion of the burner cap is in the range between 1.2 mm and 1.8 mm.

6. The gas burner according to claim 5, wherein the distance between the second ring-shaped protrusion portion and the bottom portion of the burner cap is chosen such that the ratio of a circumferential flow area between the second ring-shaped protrusion portion and the bottom portion and an exit surface of the combustion gas at the flame ports is between 0.8 and 1.2.

7. The gas burner according to claim 4, the burner body further comprising a bottom wall portion concentric with and radially extending outwards from said opening, and said bulge-shaped protrusion further comprising a third ring-shaped protrusion portion facing said opening and extending substantially vertically upwards from said bottom wall portion of the burner body, wherein the third ring-shaped protrusion portion is disposed between and connects the second ring-shaped protrusion portion and the bottom wall portion of the burner body.

8. The gas burner according to claim 7, said bottom wall portion of said burner body having a convex shape viewed from above.

9. The gas burner according to claim 1, wherein the burner body is formed by aluminium and said bulge-shaped protrusion is integrally formed at said burner body.

10. The gas burner according to claim 1, wherein the burner cap is formed by a drawn sheet metal.

11. The gas burner according to claim 1, wherein the flame ports comprise elongated apertures.

12. The gas burner according to claim 11, wherein the elongated apertures are diagonally arranged at the circumferential surface portion.

13. The gas burner according to claim 12, wherein the elongated apertures are diagonally arranged such that longitudinal axes of the apertures and a vertical axis confine an angle greater than 20°.

14. The gas burner according to claim 1, wherein the circumferential surface portion of the burner cap is inclined with respect to a vertical axis.

15. The gas burner according to claim 1, wherein a passage for primary air is provided at a lower side of the burner body.

16. A cooking hob comprising the gas burner according to claim 1.

17. A gas burner comprising a burner body and a burner cap resting on said burner body, the burner cap comprising a downward facing lower portion and a circumferential surface portion that surrounds said lower portion and is bent downwards, and plurality of flame ports being distributed over the circumferential surface portion;

the burner body comprising an upward facing bottom wall, an opening in said bottom wall to accommodate a flow of a combustion mixture of gas and air into a combustion gas chamber defined between said bottom wall and said burner cap, and a bulge-shaped protrusion surrounding said bottom wall and extending upward toward said burner cap;

said bulge-shaped protrusion comprising a first protrusion portion opposing and being essentially parallel to said circumferential surface portion of said burner cap, and a second protrusion portion opposing and being essentially parallel to said lower portion of said burner cap, said first protrusion portion being arranged at a first distance from said circumferential surface portion and said second protrusion portion being arranged at a second distance from said lower portion, said bulge-shaped protrusion forming a dam-like barrier that a flow of said combustion mixture from said combustion gas chamber must overcome to reach said flame ports;

wherein a flow ratio is defined as a radial flow cross-sectional area defined between said bulge-shaped protrusion and said lower portion of the burner cap on the one hand, and a total exit area defined by all said flame ports in said circumferential surface portion of said burner cap on the other hand, said flow ratio being in the range of 0.8 to 1.2.

18. The gas burner according to claim 17, said first distance being in the range of 1.5 mm to 6 mm, said second distance being in the range of 1.2 mm to 1.8 mm.

19. The gas burner according to claim 17, said bottom wall of said burner body having a convex shape viewed from above, said opening being disposed at a center thereof, said bulge-shaped protrusion further comprising a third protrusion portion facing said opening and extending substantially vertically from said bottom wall of said burner body up to said second protrusion portion.

* * * * *